United States Patent [19]

Essebaggers

[11] 4,096,885

[45] Jun. 27, 1978

[54] METHOD FOR SEALING LEAKING PIPES AND REPAIR UNIT FOR USE IN THE METHOD

[75] Inventor: Jan Essebaggers, Nieuwerkerk aan de IJssel, Netherlands

[73] Assignee: B.V. Neratoom, 's-Gravenhage, Netherlands

[21] Appl. No.: 654,398

[22] Filed: Feb. 2, 1976

[30] Foreign Application Priority Data

Feb. 5, 1975 Netherlands ..... 7501372

[51] Int. Cl.[2] ..... F16L 55/18; F28F 11/00

[52] U.S. Cl. ..... 138/97; 29/401 R; 165/76

[58] Field of Search ..... 29/157.3 R, 157.4, 401 R, 29/401 B, 402; 138/97; 165/76

[56] References Cited

U.S. PATENT DOCUMENTS

| | | | |
|---|---|---|---|
| 2,394,831 | 2/1946 | Woods | 165/76 |
| 3,488,829 | 1/1970 | Boniface | 165/76 |
| 3,962,767 | 6/1976 | Byerley et al. | 138/97 |

*Primary Examiner*—Richard E. Aegerter
*Assistant Examiner*—Richard R. Stearns
*Attorney, Agent, or Firm*—Kenyon & Kenyon

[57] ABSTRACT

A method for sealing leaking pipes in heat exchangers, comprising the installation, after detection of a leak and determination of the leaking pipe, of extension pieces on the two ends of the pipe, the severing of the pipe adjacent one end and the cutting of openings in the pipe wall adjacent the other end. Subsequently flow conductor tubes are inserted in the two ends of the pipe, and sealing caps are installed on the extension pieces. In operation the pipe is now entirely traversed by the liquid that normally flows around the non-defective pipes. The creation of so-called dead spaces (i.e., stagnant regions) is thus avoided.

5 Claims, 1 Drawing Figure

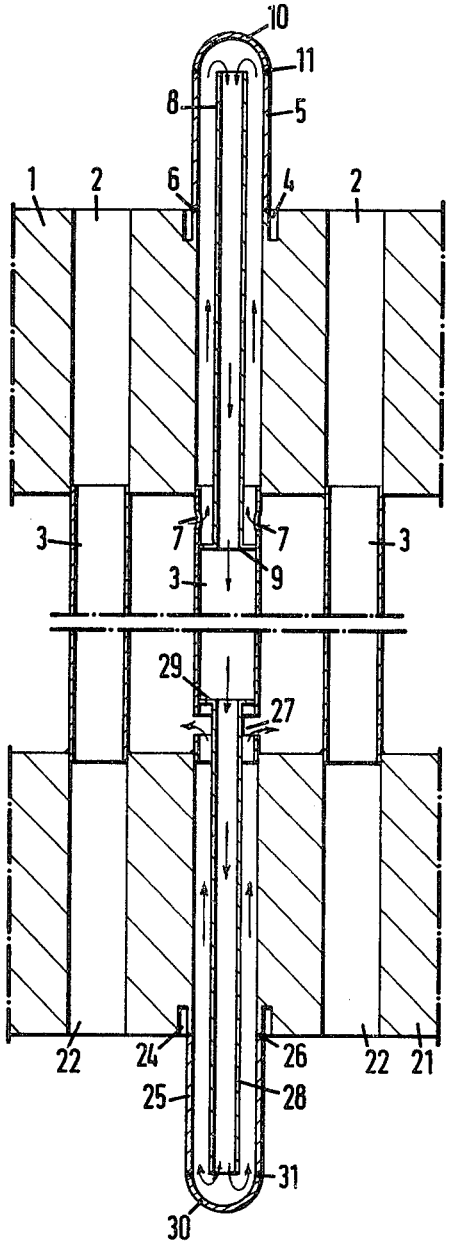
10
11
8
5
1
2
6
4
2
3
7
7
3
3
9
29
27
22
24
26
22
21
25
28
31
30

METHOD FOR SEALING LEAKING PIPES AND REPAIR UNIT FOR USE IN THE METHOD

The present invention concerns a method for sealing leaking pipes in an apparatus wherein pipes traversed by a liquid, vapour or gas, are surrounded by another liquid, comprising the installation, after detection of the leak in a pipe, of extension pieces on both ends of the pipe, or on the plate wherein the pipe ends, the cutting of the pipe adjacent one of the ends and the attachment of sealing caps on the extension pieces. The invention furthermore relates to a repair unit to be used in the method.

Apparatus comprising a plurality of pipes through which flows a liquid, vapour or gas, which pipes themselves are surrounded by another liquid, is generally known. Such apparatuses may e.g. be heat exchangers. Heat exchangers are employed in a great many different technological fields. Another example is the steam generator wherein initially water flows through the pipes, which water however, before reaching the end of the pipes is converted into steam as a result of the heating by the liquid at the exterior of the pipes.

Heat exchangers and steam generators are employed e.g. in electric powerhouses with a sodium-cooled nuclear reactor. In such systems the steam driving the turbine of the powerhouse is formed in steam generators wherein the liquid providing the heat for the steam formation is liquid sodium.

In general, and in particular in systems using sodium and water or water vapour, it is important that leaks occurring in the pipes are rapidly detected and eliminated. Methods for detecting leaking pipes are known to those skilled in the art. Once a leak in a pipe has been detected, the pipe in question is put out of operation, which is done by temporarily shutting down the apparatus of which the pipe forms part, providing the pipe in question on either end with extension pieces (e.g. having the form of sleeves) or installation of same on the pipe plate wherein the pipe ends and installation of caps on said extension pieces in sealing relationship. The pipe furthermore adjacent one of the ends is severed so that when the apparatus is again put in operation, the liquid flowing around the non-defective pipes, entirely fills the treated pipe. The cutting of the pipe, irrespective of the fact that the interior of the pipe thus becomes easily accessible to the surrounding liquid, is necessary to allow thermal expansion of the capped pipe and thus avoid thermal tensions.

As already observed the rapid detection of leaks is important, in particular in systems wherein liquid sodium and water or water vapour are employed, in order to avoid corrosion of the other pipes by reaction products formed near the leak. When sealing or capping leaking pipes in the above-described manner, it is a drawback however that any leaks occurring in and around the capped portion cannot be detected rapidly enough. The detection of leaks in sodium and water systems is based e.g. on the detection of the hydrogen formed by reaction of sodium and water adjacent the leak, which hydrogen is entrained by the sodium flowing along the pipes. In the thus sealed pipe or pipes however, only a slight or even no flow occurs, so that the detection mechanism fails.

The invention now aims at providing a method for sealing leaking pipes, wherein said drawback is not encountered and wherein such sealing is provided that in case of any leaks occurring at or adjacent the sealing, these can be detected in a conventional manner within a short period of time.

This objective is attained according to the invention in that adjacent the end of the leaking pipe opposite the end where the pipe is severed, there is disposed a plurality of openings in the pipe, while after installation of the extension pieces at the ends of the pipe, or on the plate where the pipe terminates, there is inserted into each end of the pipe a flow conductor attached suitably such that in operation the entire pipe is traversed by the other (i.e. the surrounding) liquid.

Upon application of the method according to the invention a sealing is obtained while the defective pipe in operation is traversed through entirely by the other liquid. Consequently, there do not exist so-called "dead" spaces in the capped ends of the pipe wherein the other liquid entirely or substantially entirely stands still and wherein, upon the presence of a leak, there are formed reaction products which remain trapped without contributing to the detection of the leak.

In a suitable embodiment of the method according to the invention there are employed flow conductors each of which comprises a tube having a smaller diameter than the internal diameter of the pipe to be sealed, which tube is provided with a collar at the end to be farthest inserted in the pipe, which collar, after the insertion of the tube in the pipe, substantially coacts sealingly with the pipe wall, each tube being introduced in the pipe to such extent that the collar is beyond the plurality of openings adjacent the one end and the cut adjacent the other end of the pipe, respectively.

In this embodiment of the method according to the invention there is obtained a sealing whereby, in operation, the entire sealed pipe is traversed by the other liquid. The other liquid enters the pipe through the openings that are disposed adjacent the one end, flowing between the pipe wall and the outer wall of the inserted tube in the direction of the end cap, subsequently moving through the inserted tube, the pipe and the other inserted tube as far as the cap on the opposite end of the pipe, and thereafter between the pipe wall and the outer wall of the other tube, leaving the pipe finally at the cut location. Reaction products formed by the presence of a leak and corrosion products collected and accumulated by possible other causes than a leak, are entrained by said throughflow and can be detected by means positioned elsewhere in the liquid flow.

A repair unit for use in the method according to the invention comprises a tube having an outside diameter smaller than the internal diameter of the pipe to be sealed, provided at one end with a flange having an outer diameter that is substantially equal to the internal diameter of the pipe to be sealed, as well as a tube portion to be applied as extension piece and a cap for sealing the extended pipe.

One embodiment of the invention will now be described by way of example, with reference to the accompanying drawing showing in cross-section a sealing made by means of the method according to the invention at each end of a pipe wherein a leak has been detected.

The picture shown on the drawing may represent e.g. a portion of a liquid sodium steam generator wherein a number of pipes 3 terminate at one end in a pipe plate 1 containing apertures 2 and terminate at the other end in a similar pipe plate 21 having apertures 22. The pipes 3 are suitably mounted in the apertures 2 and 22. Upward through the pipes 3, during operation, flows water which is converted into steam by the heat of the sodium flowing normally downward, in countercurrent flow, on the outside of the pipes (i.e., on the so-called "shell side" of the heat exchanger). The pipe plates 1 and 21 form partitions, respectively, between the steam and water spaces and the sodium space. If a leak occurs in some place in one of the pipes, there is produced hydrogen through the reaction of the sodium and the steam introduced into the sodium by the leak. Said hydrogen is entrained by the sodium and may be detected by detectors positioned elsewhere in the flow. This detection technique is known to those skilled in the art. Also known is the manner in which the leaking pipe is selected from among the other pipes. The leaking pipe (e.g. the middlemost of the three pipes 3 shown in the figure) according to a suitable embodiment of the method according to the invention, is sealed as follows. Adjacent the end of the pipe 3 where it terminates in the pipe plate 1, a few holes 7 are made in the pipe wall. In the pipe plate 1 there is drilled a groove 4 around the opening providing access to the pipe. To the wall which is left between the groove 4 and the opening, there is welded an extension piece or sleeve 5. The groove 4 is made in order to check the weld 6 between the sleeve 5 and the pipe plate 2, e.g. by means of an X-ray photograph. To this effect an X-ray film is positioned around the weld 6 in the groove 4, and an X-ray source in the form of a pill is introduced in the sleeve 5 and positioned adjacent the weld 6. Irregularities in the weld are detectable on the X-ray film after development.

In the opening 2 and the contiguous sleeve 5 there is subsequently inserted a flow conductor comprising a tube 8 with a collar 9 at the end farthest inserted in the pipe 3. The collar 9 has a diameter that substantially corresponds with but is slightly larger than the inner diameter of the pipe 3, so that the collar 9 can sealingly coact (e.g. by a force fit) with the wall of the pipe 3. The tube 8 is inserted in the pipe 3 until the collar 9 is located beyond the openings 7. The tube 8 has such a length that the other end terminates substantially adjacent the end of the sleeve 5. After the tube 8 has been inserted in the sleeve 5, the contiguous opening 2 and the pipe 3, a cap 10 is welded on the sleeve 5. The weld 11 is again suitably inspected, e.g. by means of an X-ray photograph.

At the other end of the pipe to be sealed an analogous process takes place, except that instead of the installation of the openings 7 the pipe is entirely cut, as at 27, for the reason previously discussed. The collar 29 of the tube 28 at the other end is installed tightly in the pipe 3 beyond the cut location (seen from the pipe plate 21 at that end).

When according to the invention the pipe has been sealed or capped, the apparatus can be put in operation again. During operation liquid sodium flows as shown by arrows in the figure via the openings 7 through the space between the outer wall of the tube 8 and the inner wall of the pipe 3 above collar 9, the opening in the pipe plate and the inner wall of the sleeve 5 and then, subsequently flowing downward through the tube 8 into the pipe 3. At the other end the flow takes place in the opposite sense, with the sodium leaving the pipe via the cut 27. If a leak occurs in the grooves 4 or 24, the welds 6 or 26, the sleeves 5 or 25, the welds 11 or 31, or the caps 10 or 30, hydrogen produced by the reaction of sodium and water will be entrained with the sodium flowing along said parts and subsequently detected after a short period of time, thus avoiding the damage that could occur if it takes too long to detect a leak.

I claim:

1. A method for sealing off a leaking pipe in a bundle of pipes having first and second open ends terminating, respectively, in spaced apart first and second header plates of an apparatus adapted to transfer heat between a fluid flowing through the pipes from the outer side of one header plate to the outer side of the other header plate and a liquid flowing through the space surrounding the pipes between the inner sides of the header plates, the method including severing the leaking pipe adjacent to the inner side of the first header plate to permit liquid to enter the pipe from said surrounding space and to prevent thermal stresses in the pipe, and sealing the openings to the first and second ends of the pipe with first and second closure members from the outer sides of the first and second header plates, respectively, wherein the improvement comprises:

making at least one opening through the wall of said leaking pipe adjacent to the inner side of the second header plate to permit liquid to flow between the surrounding space and the pipe interior at the at least one opening and longitudinally dividing the interior of the pipe at said first and second ends into first flow paths connecting the interior of the pipe inward of the severed portion and the at least one opening with the inner sides of the first and second closure members, respectively, and second flow paths between the inner sides of the first and second closure members, and the severed portion and the at least one opening in the pipe wall, respectively, such that liquid passing through the severed portion and the at least one opening through the pipe wall will traverse the entire length of the pipe and flow past the inner faces of the first and second closure members, thereby avoiding any region of stagnant liquid adjacent to the closure members.

2. A method according to claim 1 wherein each of said first flow paths is a passageway centrally located within the pipe, and each of the second flow paths is an annular passageway surrounding the corresponding first flow path.

3. A method for sealing off a leaking pipe in a bundle of pipes having first and second open ends terminating, respectively, in spaced apart first and second header plates of an apparatus adapted to have a fluid flowing through the pipes from the outer side of one header plate to the outer side of the other header plate and a liquid flowing through the space surrounding the tubes between the header plates, the method including severing the leaking pipe adjacent to the inner side of the first header plate, to permit free differential thermal expansion of the pipe relative to the remainder of the bundle, and installing first and second sealing members for the open ends of the pipe at locations spaced outwardly from the inner sides of the respective first and second header plates, wherein the improvement comprises:

making at least one opening through the pipe wall adjacent to the inner side of the second header plate to permit flow of liquid between the pipe interior and the surrounding space adjacent to the second header plate and inserting first and second elongated flow conductor means into the respective first and second ends of the pipe prior to installing the first and second sealing members, the flow conductor means having inner ends that contact the wall of the pipe at locations inwardly of the severed portion and of the at least one opening, respectively, and outer ends adjacent to but spaced inwardly from the locations of the respective first and second sealing members, the flow conductors dividing the interior of each end portion of the pipe into respective passageways extending from the pipe interior inward of the inner ends of the first and second flow conductors to the spaces between the outer ends of said conductors and the respective adjacent sealing members and respective separate passageways extending from said spaces between the outer ends of said conductors and the adjacent sealing members to the severed portion and the at least one opening through the pipe wall, respectively, whereby liquid from the space surrounding the pipe may traverse the full length of the interior of the pipe and flow past the interior faces of the first and second sealing means.

4. A method for sealing off a leaking pipe in a bundle of pipes having first and second ends terminating in respective first and second header plates of an apparatus adapted to transfer heat between a fluid flowing through the pipes from the outer side of one header plate to the outer side of the other header plate and a liquid flowing through the space surrounding the pipes, the method including severing the leaking pipe adjacent to the inner side of the first header plate to permit free differential thermal expansion of the pipe relative to the remainder of the tube bundle, attaching first and second extension pieces beyond the ends of the pipe on the outer sides of the first and second header plates, respectively, and sealing the outer ends of the first and second extension pieces, wherein the improvement comprises:

making at least one opening through the pipe wall adjacent to the inner side of the second header plate to permit flow of liquid between the pipe interior and the surrounding space adjacent to the second header plate;

inserting a first flow conductor into the first end of the pipe, the first flow conductor having an inner end that contacts the wall of the pipe inwardly of the severed portion and an outer end positioned adjacent to the outer end of the first extension piece, the first flow conductor dividing the interior of the first end of the pipe into a passageway extending from the pipe interior inwardly of the inner end of the first flow conductor to the space adjacent to the outer end of the first extension piece and another passageway extending from said space to the severed portion of the pipe to cause liquid passing through the severed portion between the outside and the interior of the pipe to flow through said space adjacent to the outer end of the first extension piece; and inserting a second flow conductor into the second end of the pipe, the second flow conductor having an inner end that contacts the wall of the pipe inwardly of said at least one opening and an outer end positioned adjacent to the outer end of the second extension piece, the second flow conductor dividing the interior of the second end of the pipe into a passageway extending from the pipe interior inwardly of the inner end of the second flow conductor to the space adjacent to the outer end of the second extension piece and another passageway extending from said last named space to the at least one opening through the wall of the pipe to cause liquid passing through the at least one opening between the outside and interior of the pipe to flow through said space adjacent to the outer end of the second extension piece, whereby there will be no stagnant liquid in the regions adjacent to the sealed outer ends of the extension pieces that would prevent early detection of leaks in said sealed outer ends.

5. A method according to claim 4 wherein the first and second flow conductors comprise open tubes, each tube having an outside diameter sufficiently smaller than the inside diameter of the pipe to provide an annular flow path therebetween, and an annular collar surrounding the inner end of the tube for providing a sealing connection between the outer surface of the tube and the inner surface of the pipe wall.

* * * * *